US005797289A

United States Patent [19]

Hoshino

[11] Patent Number: 5,797,289

[45] Date of Patent: Aug. 25, 1998

[54] BENDING SYSTEM FOR BENDING TUBE

[75] Inventor: Masaki Hoshino, Sunto-gun, Japan

[73] Assignee: Usui Kokusai Sangyo Kaisha Limited, Japan

[21] Appl. No.: 795,069

[22] Filed: Feb. 5, 1997

[51] Int. Cl.[6] ..... B21D 7/04

[52] U.S. Cl. ..... 72/17.3; 72/149; 72/702

[58] Field of Search ..... 72/702, 307, 151, 72/154, 149, 17.3

[56] References Cited

U.S. PATENT DOCUMENTS

| | | | |
|---|---|---|---|
| 3,352,136 | 11/1967 | Clarke | 72/702 |
| 4,122,697 | 10/1978 | Hanyo | 72/702 |
| 4,662,204 | 5/1987 | Saegusa | 72/306 |
| 4,732,025 | 3/1988 | Marlinga et al. | 72/150 |
| 4,735,075 | 4/1988 | Saegusa | 72/306 |
| 4,802,357 | 2/1989 | Jones | 72/702 |
| 4,805,436 | 2/1989 | Saegusa | 72/306 |
| 4,959,984 | 10/1990 | Trudell et al. | 72/150 |
| 4,979,385 | 12/1990 | LaFrasse | 72/702 |
| 5,197,320 | 3/1993 | Saegusa | 72/307 |
| 5,275,031 | 1/1994 | Whiteside | 72/702 |
| 5,285,668 | 2/1994 | Tokai | 72/17.3 |
| 5,305,223 | 4/1994 | Saegusa | 72/149 |
| 5,483,809 | 1/1996 | Nishiie et al. | 72/150 |

FOREIGN PATENT DOCUMENTS

| | | | |
|---|---|---|---|
| 92120 | 5/1984 | Japan | 72/702 |

*Primary Examiner*—Daniel C. Crane

*Attorney, Agent, or Firm*—Anthony J. Casella; Gerald E. Hespos; Ludomir A. Budzyn

[57] ABSTRACT

A tube bending system for bending all tubes in a preset manner effectively from the beginning of works by detecting a degree of bending of a tube which varies during a bending process in high precision by a displacement sensor and by accurately comparing the detected value of the degree of bending of the tube detected by the displacement sensor with a control value written in advance in a program in a memory. The displacement sensor is disposed so as to be able to detect the position of the tube to be bent on the side of a reaction receiving section between a gripper and the reaction receiving section. The displacement sensor is composed of a detecting section and a transducing section. A value which indicates the position of the tube to be bent detected by the detecting section is transduced to a degree of bending of the tube to be bent by the transducing section and the transduced degree of bending is transmitted to a controller during repetitive operation for bending the tube so that the degree of bending approaches to the predetermined degree of bending.

4 Claims, 4 Drawing Sheets

BENDING SYSTEM FOR BENDING TUBE

BACKGROUND OF THE INVENTION

1. Field of the Invention

The present invention relates to a tube bending system and more particularly to a bending system for bending a tube while applying tensile force to the tube to be bent.

2. Description of Related Art

Bending of metallic tubes is carried out very often in automobile and home appliance industries for example and holds an important position there. Accordingly, tubes incorporated in automobiles and home appliances are required to be bent in high precision at a predetermined angle and at a predetermined position in the longitudinal direction so as to extend avoiding other parts or to connect with other parts.

Hitherto, such bending is carries out on the tubes by implementing preset bending to the tube so be bent while taking spring back into consideration by gripping means for gripping the tube to move to and set at the predetermined position and die means for implementing the bending to the tube at the predetermined angle and at the predetermined position. After completing the bending, a three-dimensional measuring instrument is used to measure whether an influence of the spring back exists or not and to check a bending size of the tube. When it is necessary to correct the size, a travel of the gripping means and a degree of bending of the die means are adjusted in carrying out the next bending.

Japanese Patent Laid-Open No. 63-290624 has proposed a tube bending system which is adapted to detect a predetermined position between the edge of a tube to be bent and the bending position of the tube by position sensor means after implementing preset bending to the tube to be bent by gripping means for gripping and moving the tube to the predetermined position and die means for bending the tube at a predetermined position and at a predetermined angle.

According to this proposed bending system, the position of the sprung back tube to be bent is detected by the position sensor means after bending the tube and the degree of bending of the die means is changed by control means so that the position agrees with the preset value to realize the preset bending.

Further, the present applicant has proposed a tube bending system as described in Japanese Patent Laid-Open No. Hei. 4-111932. In this publication, the present applicant has proposed a tube bending system comprising a bending die which faces to the peripheral surface of a tube to be bent in contact and which is turnable centering on an axis of rotation, a pressing die unit which moves and sets the tube to be bent at position for pinching it together with the bending die and which is turnable centering on the axis of rotation while pinching the tube to be bent at the peripheral surface of the bending die, a sensor provided on the pressing die unit to detect a degree of bending of the tube to be bent and a controller for turning the pressing die unit centering on the axis of rotation in accordance to a program to bend the tube to be bent so that the degree of bending detected by the sensor approaches to a predetermined value and for releasing the setting thereafter.

Because the degree of bending is adjusted by measuring the bending size by the three-dimensional measuring instrument after bending the first tube in the above-mentioned prior art bending system, the tube which has been bent at the first time cannot be used as a product in many cases. Further, although the degree of bending may be applied when the tube to be bent is relatively short, the degree of bending had to be adjusted again at each time when the tube to be bent is long because a one tube is affected by the difference of hardness, elastic limit and yield strength caused by dispersion of material, thickness and heat treatment condition of the tube to be bend.

Further, when the tube to be bent is thin, there is a case when the bending size cannot be measure accurately because the tube to be bent may deflect in measuring by the three-dimensional measuring instrument.

The bending system proposed in Japanese Patent Laid-Open No. 63-290624 has had a problem that when a tube to be bent is long, the size of position sensor means increases greatly, thus causing it difficult to use the system practically. When a tube to be bent is thin on the other hand, the closer to the edge of the tube, the greater the deflection of the tube to be bent after bending becomes, thus causing it very difficult to detect the position in high precision.

The bending system proposed in Japanese Patent Laid-Open No. Hei. 4-111932 has had also a problem that it is not easy to bend in high precision because a displacement of a tube to be bent detected by the sensor provided on the pressing die unit detects only the spot where there is less variation of size of the tube and shows only a very small displacement when the portion to be bent is short.

Therefore, a tube bending system which can bend tubes in high precision regardless of size of the tubes and without being affected by the difference of hardness, elastic limit and yield strength caused by the dispersion of material, thickness and heat treatment condition of the tube has been required.

SUMMARY OF THE INVENTION

Accordingly, it is an object of the present invention to meet the above-mentioned needs by providing a tube bending system which can bend all tubes in a predetermined manner from the beginning of the work by detecting a degree of bending of the tube to be bent which accompanies spring back by a displacement sensor in high precision during a tube bending process and by comparing the detected value of the degree of bending of the tube to be bent detected by the displacement sensor with a control value stored in a program in a memory in advance.

In order to achieve the above-mentioned object, the inventive bending system for bending the tube to be bent is memory in which a program for bending the tube to be bent is stored; a gripper for gripping the rear end of the tube to be bent to move it in the axial direction and around the axis in accordance to the program read from the memory; a bending die disposed so as to face around the tube to be bent in contact and to be turnable around an axis of rotation; a reaction receiving section disposed so as to face to the bending die; a pressing die unit which is turnable centering on the axis of rotation while pinching the tube to be bent; a displacement sensor provided between the gripper and the reaction receiving section to detect the position of the tube to be bent; and a controller for controlling a series of operations of setting the pressing die unit in accordance to the program read from the memory, turning the pressing die unit centering on the axis of rotation, adding an error detected by the displacement sensor to the predetermined bending value of the program to bend so as to approach to the predetermined value and releasing the setting thereafter.

Preferably, the displacement sensor is disposed so as to be movable in the direction orthogonal to the axis of the tube to be bent.

The specific nature of the invention, as well as other objects, uses and advantages thereof, will be clearly appear from the following description and from the accompanying drawings.

DESCRIPTION OF PREFERRED EMBODIMENTS

The present invention will be explained in detail below with reference to FIGS. 1 through 5.

The present invention is characterized basically in that a displacement sensor is provided so as to detect a variation between the position of a tube restituted and moved in the direction opposite from the bending direction due to spring back caused when the rear end of the tube which has been gripped by a gripper is released after bending the tube and the original position of the tube before the bending (hereinafter referred to as variation of position of the tube to be bent).

That is, the displacement sensor for detecting the variation of position of the tube to be bent is disposed preferably on the side of a reaction receiving section between the gripper and the reaction receiving section to detect the variation of position of the tube in higher precision. The displacement sensor is composed of a detecting section and a transducing section. A value indicating the position of the tube detected by the detecting section is transduced into a degree of bending of the tube by the transducing section to store in a memory. The transduced degree of bending is also transmitted to a controller during repetitive bending of the tube to compare with a predetermined degree of bending in a program of the controller. When there is an error between them, the error is added to the predetermined degree of bending to bend the tube so as to approach to the predetermined value.

The displacement sensor disposed to detect the variation of position of the tube indicating an influence of reaction force of the bending stress applied to the tube to be bent is placed and secured to a displacement sensor moving unit which is disposed so as to be movable in the direction orthogonal to an axis of the tube to be bent. The moving unit is arranged so as not only to move the displacement sensor measuring point but also so that the displacement sensor would not hinder in setting or in taking out the tube after bending.

Figure 1:
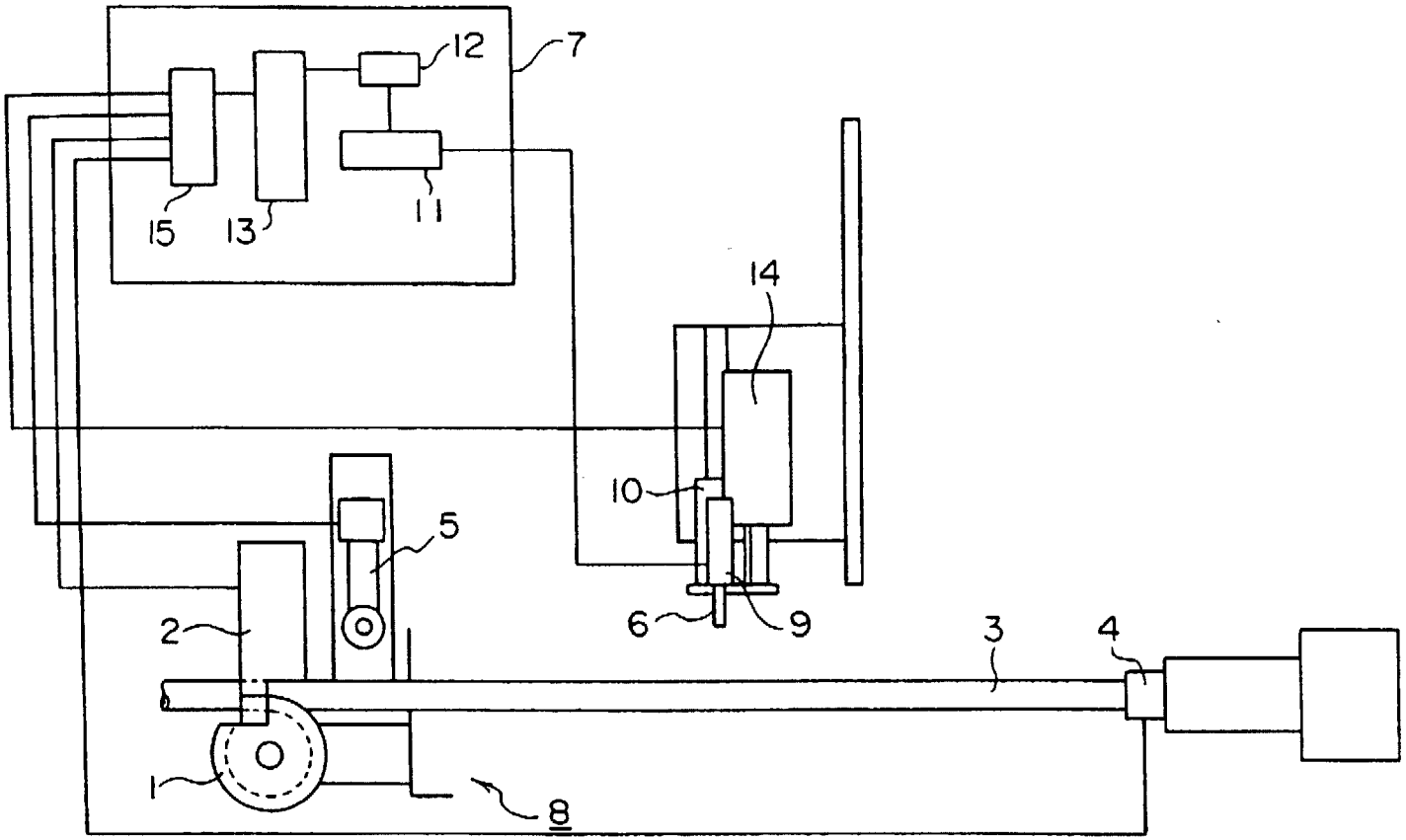
FIG. 1 is an explanatory diagram showing a structure of a tube bending system of the present invention.
Figure 2:
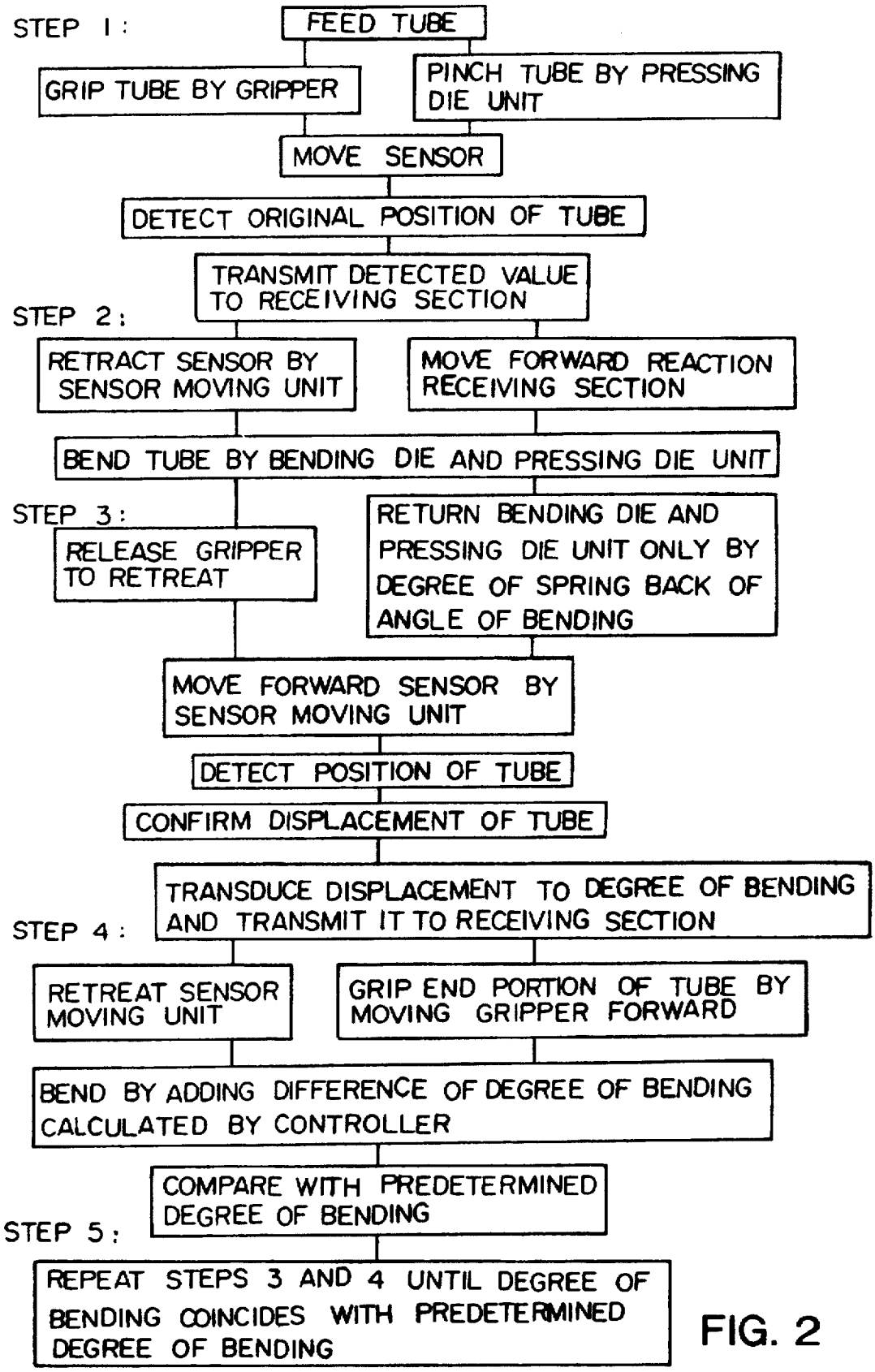
FIG. 2 is a flowchart showing procedures in operating the tube bending system of the present invention.
Figure 3:
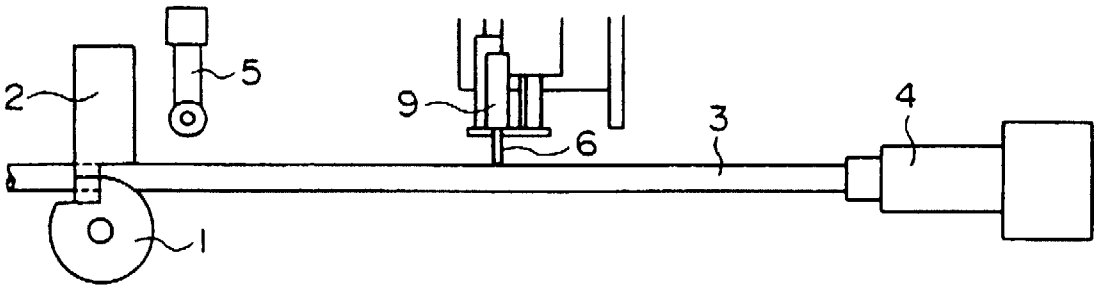
FIG. 3 is an explanatory diagram showing a first step of the operation of the tube bending system of the present invention.
Figure 4:
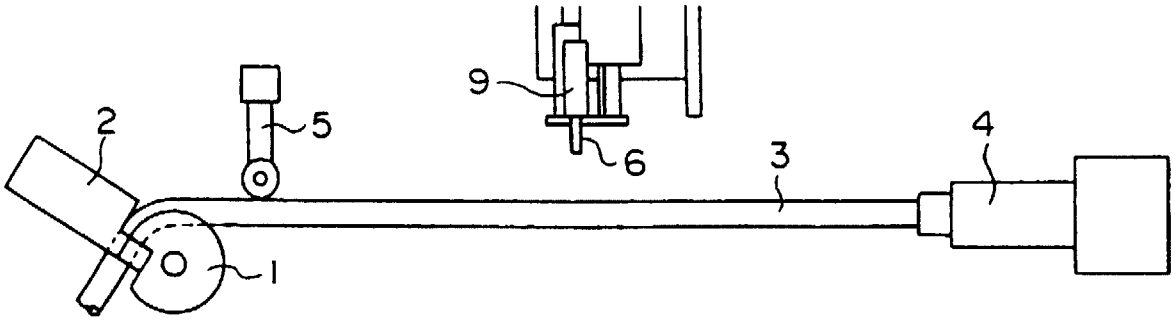
FIG. 4 is an explanatory diagram showing a second step of the operation of the tube bending system of the present invention.

As shown in FIG. 1, the inventive tube bending system 8 comprises a bending die 1, a pressing die unit 3 disposed so as to face to the bending die 1, a gripper 4 for gripping the rear end of a tube to be bent 3 pinched between the bending die 1 and the pressing die unit 2, a reaction receiving section 5 provided so as to face to the bending die 1 between the gripper 4 and the pressing die unit 2, a displacement sensor 6 disposed between the reaction receiving section 5 and the gripper 4 and on the side of the reaction receiving section 5 and a controller 7 for controlling a degree of bending from the variation of position of the tube to be bent 3 detected by the displacement sensor 6.

The displacement sensor 6 is composed of a detecting section 9 and a transducing section 10. The controller 7 comprises a receiving section 11 for receiving the degree of bending of the tube to be bent detected, transduced and transmitted by the displacement sensor 6, a memory 12 for storing a predetermined degree of bending in advance, a CPU 13 in which a program for comparing the signal of the receiving section 11 with the predetermined degree of bending in the memory 12 to calculate and control an adequate degree of bending is stored; and an input/output circuit 15 for feeding back the control value calculated by the CPU to each part of the pressing die unit 2, the reaction receiving section 5, the gripper 4 and a displacement sensor moving unit 14 on which the displacement sensor 6 is placed and which is disposed so as to be movable in the direction orthogonal to the axial direction of the tube to be bent 3 to control the degree of bending of the tube to be bent adequately.

As shown in FIG. 2 and FIGS. 3 through 5, procedures in operating the inventive tube bending system comprises steps of holding the tube to be bent 3 at the bending position (Step 1), bending the tube to be bent 3 held at the bending position (Step 2), comparing the degree of bending applied in the tube bending step and the predetermined degree of bending (Step 3) and bending again to compensate an error between the degree of bending and the predetermined degree of bending obtained in Step 3 (Step 4).

In Step 1, after setting the tube to be bent 3 at the target position, the tube 3 is gripped by the rear end by the gripper 4 and the pressing die unit 2 is manipulated to pinch the tube 3. Next, the displacement sensor 6 is moved forward to the tube to be bent 3 up to a measuring position by the displacement sensor moving unit 14 to measure and detect the original position of the tube to be bent 3 before bending. The detected value is transmitted to the receiving section 11 to store in the memory 12 (see FIG. 3).

Next, in Step 2, the displacement sensor 6 is retreated by the displacement sensor moving unit 14 and the reaction receiving section 5 is moved forward up to a predetermined position. Then, the tube to be bent 3 is bent while applying tensile force to the tube by turning in centering on the same axis of rotation while pinching it centering on the same the pressing die unit 2 by a theroetical degree of bending calculated by the controller 7. At this time, the theoretical degree of bending caused by the bending die 1 and the pressing die unit 2 should not exceed an angle of return caused by the spring back of the tube to be bent 3 (see FIG. 4).

Figure 5A:
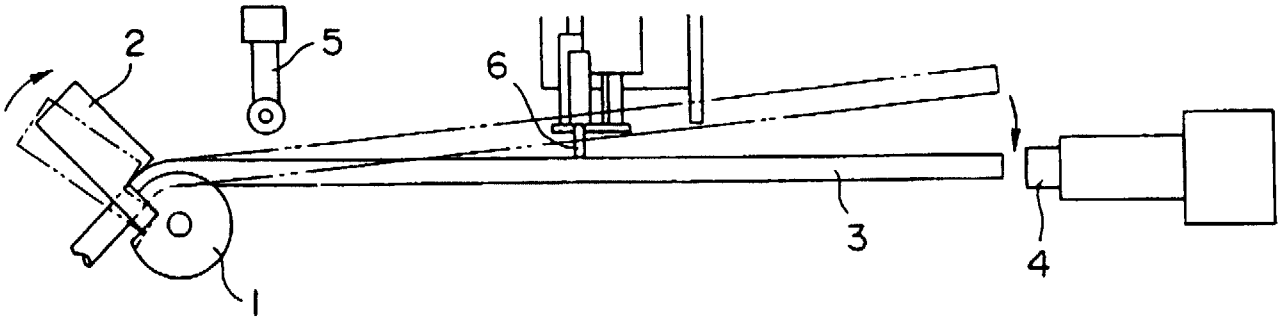
FIGS. 5*a* and 5*b* are explanatory diagrams showing a third step of the operation of the tube bending system of the present invention as steps of two embodiments, respectively.

In Step 3, the gripper 4 is released and retreated and the bending die 1 and the pressing die unit 2 are turned in the direction opposite from the bending direction while pinching the tube to be bent 3 from the position of the dotted line in FIG. 5*a* to return by the angle of bending only by the degree of spring back within the theoretical degree of bending. The displacement sensor 6 is moved forward in this state by the displacement sensor moving unit 14 to detect the position of the tube 3 after the bending. It is then compared with the original position detected in the previous Step 1 to detect a variation of position of the tube to be bent 3 caused by the bending. At this time, the displacement of the tube to be bent 3 is transduced to a degree of bending by the transducing section 10 of the displacement sensor 6 and is transmitted to the receiving section 11 to store in the memory 12. It is noted that when the position of the tube to be bent 3 detected in Step 3 coincides with the original position detected in Step 1, the bending is completed and the degree of bending is stored in the memory 12 to be used in bending tubes thereafter (see FIG. 5). According to the embodiment shown in FIG. 5*a*, because the tube to be bent 3 is turned in the opposite direction while being pinched by the bending die 1 and the pressing die unit 2, almost no restitution phenomenon occurs at the rear end side of the tube to be bent 3. Accordingly, it allows the measurement to be carried out immediately by the displacement sensor 6 and to prevent the displacement sensor 6 from being damaged which might otherwise occur when the tube to be bent 3 contacts or impacts against the displacement sensor 6. Thus, it increases the reliability of the tube to be bent 3 and the whole bending system.

Figure 5B:
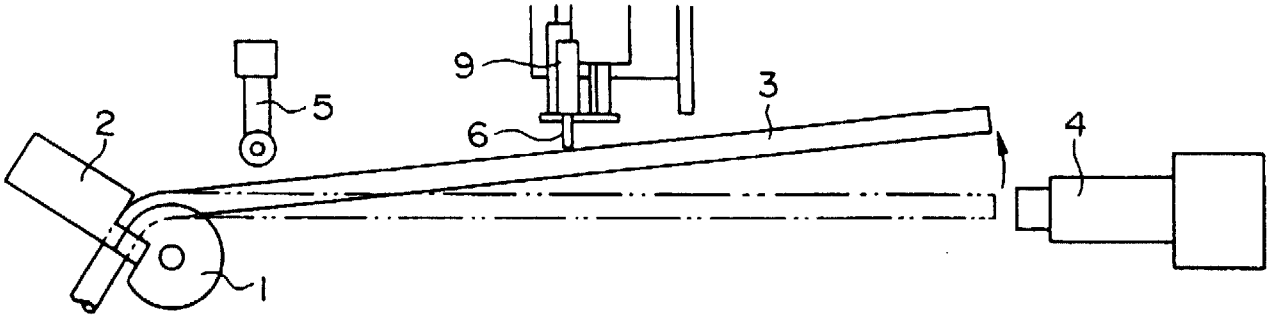

When the tube to be bent 3 has a rigidity and when there is no or little restitution due to the spring back, the system may be arranged as shown in FIG. 5*b*.

That is, in Step 3, the gripper 4 is released and retreated and the reaction receiving section 5 is retreated while pinching the tube to be bent 3 by the bending die 1 and the pressing die unit 2. Then, the rear end of the tube to be bent 3 which has been gripped by the gripper 4 moves to the side of the displacement sensor 6, thus moving from the position of the dotted line to that of the solid line in FIG. 5*b*. The displacement sensor 6 is moved forward by the displacement sensor moving unit 14 in this state to detect the position of the tube to be bent 3 after the bending and to compare it with the original position detected in the previous Step 1 to detect a variation of position of the tube 3 caused by the bending. At this time, the displacement of the tube 3 is transduced to a degree of bending by the transducing section 10 of the displacement sensor 6 and is transmitted to the receiving section 11 to be stored in the memory 12. It is noted that when the position of the tube 3 detected in Step 3 coincides with the original position detected in Step 1, the bending is completed and the degree of bending is stored in the memory 12 to utilize in bending tubes thereafter.

When the detected variation of position is short from the predetermined degree of bending on the other hand, the procedure advances to Step 4.

In Step 4, after retreating the displacement sensor 6 by the displacement sensor moving unit 14, the tube to be bent 3 is turned in the opposite direction while pinching by the bending die 1 and the pressing die unit 2 to return to the original position in Step 2. Next, the gripper 4 is moved forward to grip the rear end of the tube to be bent 3 and the bending die 1 and the pressing die unit 2 are manipulated to bend again as shown in FIG. 5*b* by newly adding the difference of shortage between the degree of bending obtain in Step 3 and the predetermined degree of bending to the predetermined degree of bending calculated by the controller 7.

When a detected degree of bending obtained in Step 4 is still short from the predetermined degree of bending, the same operation with Step 3 is carried out on the tube to be bent 3 obtained in Step 4. That is, Steps 3 and 4 are repeated until the predetermined degree of bending is obtained. When the predetermined degree of bending is obtained, it is stored in the memory 12 to use in bending tubes thereafter.

When the above-mentioned bending is carried out, because the original position of the tube to be bent 3 is detected in Step 1, data of bending of the tube to be bent 3 detected in and after Step 2 may be used in bending the same tubes thereafter. It also allows to eliminate the production of a useless bent tube which has been otherwise produced in the initial stage.

Further, it allows to cause the degree of bending to fall within a predetermined range of degree of bending even if hardness of the tube to be bent 3 fluctuates per lot.

It is noted that although the case of using the contact type displacement sensor as the displacement sensor has been explained in FIG. 1, the present invention is not confined only to such a case and the bending system may be constructed by a displacement sensor such as a photoelectric type displacement sensor or light cutoff type displacement sensor which can detect a distance.

As described above, the present invention allows the variation of the position of the tube to be bent, i.e. the degree of spring back, to be detected accurately by arranging it such that the displacement sensor for confirming the position of the tube to be bent is disposed between the gripper and the reaction receiving section where the degree of spring back after the bending is relatively large and on the side of the reaction receiving section, the data of bending of the first tube to be applied as it is in bending tubes thereafter, and tubes which have been bent in high precision to be provided stably as a result even if the material, thickness and heat treatment condition of the tubes are different.

While a preferred embodiment has been described, variation thereto will occur to those skilled in the art within the scope of the present inventive concepts which are delineated by the following claims.

What is claimed is:

1. A tube bending system for placing at least one bend of a specified tube, said tube having a front end, a rear end and an axis extending therebetween, comprising:

a memory in which a program for bending the tube is stored, said program identifying at least one predetermined bending value;

a gripper for gripping the rear end of said tube and for moving said tube in the axial direction and around the axis in accordance with the program in said memory;

a bending die disposed to face and contact a first longitudinal side of said tube;

a pressing die unit disposed to face the bending die and to contact a second longitudinal side of said tube, said second longitudinal side being opposite said first longitudinal side, said pressing die unit being turnable around said axis of rotation while pinching said tube against said bending die;

a reaction receiving section between said gripper and said pressing die and disposed to face the second longitudinal side of the tube;

a displacement sensor between said gripper and said reaction receiving section in spaced relationship from said reaction receiving section and disposed to face the second longitudinal side of the tube for detecting the position of said tube, said displacement sensor being reversibly movable independently of said reaction receiving section in directions orthogonal to the axis of the tube; and a controller for controlling setting of said pressing die unit in accordance with the program in said memory, turning said pressing die unit around said axis of rotation to said predetermined bending value, adding an error detected by said displacement sensor to the predetermined bending value of said program so as to approach the specified value, and releasing said setting of said pressing die unit thereafter.

2. The tube bending system according to claim 1, wherein said displacement sensor comprises a detecting section for detecting a variation of position of said tube to be bent and a transducing section for transducing a displacement of said tube to be bent to a degree of bending.

3. The tube bending system according to claim 1, comprising:

a receiving section for receiving a degree of bending of said tube to be bent which has been detected, transduced and transmitted by said displacement sensor;

a memory for storing a predetermined degree of bending in advance;

a CPU in which a program for comparing the signal of said receiving section with the predetermined degree of bending to calculate and control an adequate degree of bending; and an input/output circuit for feeding back the control value calculated by said CPU to each part of said pressing die unit, said reaction receiving section, said gripper and a displacement sensor moving unit on which said displacement sensor is placed and which is disposed so as to be movable in the direction orthogonal to the axial direction of said tube to be bent to control the degree of bending of said tube to be bent adequately.

4. The tube bending system according to claim 1, wherein said displacement sensor is a contact type displacement sensor, a discharge type displacement sensor or a light cutoff type displacement sensor.

* * * * *